US005472744A

United States Patent [19]

Castegnier et al.

[11] Patent Number: 5,472,744

[45] Date of Patent: Dec. 5, 1995

[54] METHOD FOR COATING A METALLIC SUBSTRATE WITH AN OILY SUBSTANCE

[75] Inventors: Adrien Castegnier, Outremont; Gilles Gadbois, Rawdon, both of Canada

[73] Assignee: Elcorsy Inc., Saint-Laurent, Canada

[21] Appl. No.: 230,213

[22] Filed: Apr. 20, 1994

Related U.S. Application Data

[62] Division of Ser. No. 185,528, Jan. 24, 1994.

[51] Int. Cl.[6] ..... B05D 1/28

[52] U.S. Cl. ..... 427/428; 427/453; 118/262; 118/244

[58] Field of Search ..... 427/428, 453; 118/262, 244

[56] References Cited

U.S. PATENT DOCUMENTS

| | | | |
|---|---|---|---|
| 3,952,700 | 4/1976 | Little, Jr. et al. | 118/262 |
| 4,282,275 | 8/1981 | Werner | 427/428 |
| 4,372,244 | 2/1983 | Rebel | 118/262 |
| 4,485,132 | 11/1984 | Furuzono et al. | 118/262 |
| 4,680,097 | 7/1987 | Castegnier | 204/180.1 |
| 4,895,629 | 1/1990 | Castegnier et al. | 204/180.9 |
| 5,176,940 | 1/1993 | Salo et al. | 427/202 |

OTHER PUBLICATIONS

F. T. Jaeger, "Flame Sprayed Ceramic Coatings as an Economic Alternative to Spray and Fuse Coatings for Frictional and Corrosive Use", '85 ASM's International Conference on Surface Modifications and Coatings, Toronto, Ontario, Canada, 14–16 Oct. 1985.

*Primary Examiner*—Shrive Beck
*Assistant Examiner*—Katherine A. Bareford
*Attorney, Agent, or Firm*—Swabey Ogilvy Renault

[57] ABSTRACT

A method for coating a metallic substrate with an oily substance. Use is made of a support member having a ceramic coating comprising an oxide ceramic material, onto which is applied the oily substance to form a film of the oily substance uniformly covering the surface of the ceramic coating, the film of oily substance breaking down into micro-droplets having substantially uniform size and distribution. The micro-droplets of oily substance are thereafter transferred onto a surface of the metallic substrate without substantially altering the size and distribution of the micro-droplets, thereby coating the surface of the metallic substrate with the oily substance. The invention is particularly useful for coating the positive electrode of a high-speed electro-coagulation printing apparatus with an olefinic substance containing a metal oxide.

19 Claims, 6 Drawing Sheets

METHOD FOR COATING A METALLIC SUBSTRATE WITH AN OILY SUBSTANCE

This application is a division of application Ser. No. 08/185,528, filed Jan. 24, 1994.

BACKGROUND OF THE INVENTION

The present invention relates to improvements in the field of coating metallic substrates. More particularly, the invention is concerned with an improved method and apparatus for coating a metallic substrate with an oily substance.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent corrosion of the positive electrode. In addition, any gas generated as a result of electrolysis upon energizing the negative electrodes is consumed by reaction with the olefinic substance so that there is no gas accumulation between the negative and positive electrodes.

The dispersion containing the olefinic substance and the metal oxide is applied onto the surface of the positive electrode in a manner such as to form on the electrode surface micro-droplets of olefinic substance containing the metal oxide. As described in the aforementioned patent, this may be achieved by means of a device comprising a rotatable brush provided with a plurality of radially extending horsehair bristles having extremities contacting the electrode surface, and a distribution roller arranged in spaced-apart parallel relation to the brush such as to contact the bristles thereof at their extremities. The distribution roller has a plurality of peripheral longitudinally extending grooves and is partially immersed in a bath containing the dispersion. As the distribution roller rotates in the dispersion, the grooves are filled with the dispersion which is thus transferred to the bristles to coat the extremities thereof. Rotation of the brush, on the other hand, causes the coated bristles to transfer the dispersion onto the surface of the positive electrode and thereby form the desired micro-droplets of olefinic substance containing the metal oxide. Instead of a brush, use can be made of a roller provided with a plurality of radially extending strip of chamois leather adapted to contact the electrode surface, the strips being coated in the same manner as the bristles. Rotation of such a roller causes the coated strips to impinge upon the surface of the positive electrode such as to transfer thereon the dispersion and thereby form the desired micro-droplets of olefinic substance containing the metal oxide. Although both types of devices provide micro-droplets of substantially uniform size, the micro-droplets formed on the surface of the positive electrode have a random distribution which adversely affects the image reproduction. In addition, as the strips of chamois leather carry abrasive particles of metal oxide and impinge at high speed on the electrode surface, they suffer from premature wear.

SUMMARY OF THE INVENTION

It is therefore an object of the present invention to overcome the above drawbacks and to provide a method and apparatus for coating a surface of a metallic substrate with an oily substance so as to form on the surface of the substrate micro-droplets of oily substance having substantially uniform size and distribution.

According to one aspect of the invention, there is provided a method of coating a metallic substrate with an oily substance, which comprises the steps of:

a) providing a support member having a ceramic coating comprising an oxide ceramic material;

b) applying the oily substance onto the ceramic coating to form on a surface thereof a film of the oily substance uniformly covering the surface of the ceramic coating, the film of oily substance breaking down into micro-droplets having substantially uniform size and distribution; and c) transferring the micro-droplets of oily substance onto a surface of the metallic substrate without substantially altering the size and distribution of the micro-droplets, thereby coating the surface of the metallic substrate with the oily substance.

The present invention also provides, in another aspect thereof, an apparatus for carrying out a method as defined above. The apparatus of the invention comprises:

support member having a ceramic coating comprising an oxide ceramic material;

applicator means for applying the oily substance onto the ceramic coating to form on a surface thereof a film of the oily substance uniformly covering the surface of the ceramic coating, the film of oily substance breaking down into micro-droplets having substantially uniform size and distribution; and transfer means for transferring the microdroplets of oily substance onto a surface of the metallic substrate without substantially altering the size and distribution of the micro-droplets, thereby coating the surface of the metallic substrate with the oily substance.

It has been surprisingly found, according to the invention, that the surface of a ceramic coating comprising an oxide ceramic material can be uniformly covered with a film of an oily substance, such as the olefinic substance used in Applicant's aforementioned electrocoagulation printing method and apparatus, and that such a film of oily substance breaks down on the surface into the ceramic coating of micro-droplets of oily substance having both substantially uniform size and uniform distribution. Since oxide ceramic coatings are generally produced by flame-spraying or plasma-spraying of particles of an oxide ceramic material, some of the particles projected do not undergo complete melting so that the coatings produced from such a material are porous. The ceramic coatings obtained by flame-spraying generally have a porosity representing about 15 to about 40% of the total volume of the coating, whereas those obtained by plasma-spraying generally have a lesser porosity due to the higher temperature and carrier gas velocity employed in plasma-spraying. Since, on the other hand, the particles are applied by spraying, the porosity is uniform throughout the coating so that the open pores which are formed at the surface of the coating and which have a size corresponding substantially to the size of the particles, are uniformly distributed over the entire surface of the coating. It is believed that these open pores act as anchoring sites promoting the formation of the desired micro-droplets of uniform size and distribution. The micro-droplets of oily substance formed on the surface of the ceramic coating and transferred onto the surface of the substrate have a size ranging from about 1 to about 5 μ.

A particularly preferred oxide ceramic material forming the aforesaid ceramic coating comprises a fused mixture of alumina and titania. Such a mixture may comprise about 60 to about 90 weight % of alumina and about 10 to about 40 weight % of titania. Particles of fused alumina and titania suitable for producing ceramic coatings by flame-spraying or plasma spraying are available under the trade mark "MetaCeram 25030" from Eutectic Canada Inc. Such ceramic coatings in addition to providing the desired micro-droplets when wetted by an oily substance possess exceptional abrasion/erosion resistance properties and are thus highly resistant to wear.

According to a preferred embodiment of the apparatus of the invention, the support member is a distribution roll having a peripheral coating of oxide ceramic material defining the aforesaid ceramic coating. The applicator means comprises an applicator roll extending parallel to the distribution roll and in pressure contact engagement therewith to form a first nip, means for rotating the applicator roll and the distribution roll in register and feed means for feeding the oily substance into the first nip, whereby the oily substance upon passing through the first nip forms a film uniformly covering the surface of the ceramic coating. Where the substrate is a rotatable metallic cylinder as in the case of the positive electrode of Applicant's aforementioned electrocoagulation printing apparatus, the transfer means preferably comprises a transfer roll extending parallel to the distribution roll and in contact engagement therewith to form a second nip, the transfer roll extending parallel to the cylinder, and means for positioning the transfer roll in pressure contact engagement with the cylinder to form a third nip and permit the transfer roll to be driven by the cylinder upon rotation thereof, whereby the micro-droplets are transferred from the distribution roll onto the transfer roll at the second nip and thereafter transferred from the transfer roll onto the cylinder at the third nip.

Preferably, the applicator roll and the transfer roll are each provided with a peripheral covering of a resilient, oil-resistant material such as a synthetic rubber material. For example, use can be made of a polyurethane having a Shore A hardness of about 50 to about 70 in the case of the applicator roll, or a Shore A hardness of about 60 to 80 in the case of the transfer roll.

According to another preferred embodiment, the applicator roll, distribution roll and transfer roll have respectively first, second and third central longitudinally extending shafts disposed in spaced-apart parallel relation to one another. The applicator roll, distribution roll and transfer roll are arranged between a pair of opposite planar mounting members extending in parallel planes with the shaft of each roll being mounted in bearing means within a respective shaft opening formed in each mounting member.

The apparatus of the invention advantageously includes first pressure adjustment means for adjustably varying the pressure exerted at the first nip, as well as second pressure adjustment means for adjustably varying the pressure exerted at the second nip. Where the applicator roll is provided with a peripheral covering of a resilient, oil-resistant material, the first pressure adjustment means is associated with the first shaft and comprises a separate pressure adjustment means at each shaft opening receiving the first shaft for adjustably moving the first shaft in a direction towards or away from the second shaft to correspondingly vary the pressure exerted at the fist nip. Each separate pressure adjustment means preferably comprises a cylindrical member having a central longitudinal axis, the cylindrical member being mounted in a respective shaft opening for partial rotation about its longitudinal axis with the bearing means being mounted within the cylindrical member such that the first shaft is off-set relative to the central longitudinal axis, and means for partially rotating the cylindrical member in one direction or in an opposite direction to adjustably move the first shaft in a direction towards or away from the second shaft. The pressure exerted at the first nip generally ranges from about 0.2 to about 1.5 $kg/cm^2$ and is preferably about 0.70 $kg/cm^2$.

Where the transfer roll is provided with a peripheral covering of a resilient, oil-resistant material, the second pressure adjustment means is associated with the second shaft and comprises a separate pressure adjustment means at each shaft opening receiving the second shaft for adjustably moving the second shaft in a direction towards or away from the third shaft to correspondingly vary the pressure exerted at the second nip. Each separate pressure adjustment means comprises a cylindrical member having a central longitudinal axis, the cylindrical member being mounted in a respective shaft opening for partial rotation about its longitudinal axis with the bearing means being mounted within the cylindrical member such that the second shaft is off-set relative to the central longitudinal axis, and means for partially rotating the cylindrical member in one direction or in an opposite direction to adjustably move the second shaft in a direction towards or away from the third shaft. The pressure exerted at the second nip generally ranges from about 0.2 to about 0.6 $kg/cm^2$ and is preferably about 0.35 $kg/cm^2$.

In order to readily determine the pressure exerted at the first or second nip, a pair of disc members is mounted on each of the first and second shafts with each disc member being positioned adjacent a respective shaft opening. The disc members of said first and second shafts which are disposed adjacent a respective mounting member are co-planar and spaced from one another to define a gap representative of the pressure exerted at said first nip. A further pair of disc members is mounted on the third shaft with the disc members of the further pair being each positioned adjacent a respective shaft opening. The disc members of the second and third shafts which are disposed adjacent a respective mounting member are co-planar and spaced from one another to define a further gap representative of the pressure exerted at the second nip. Thus, by calibrating each gap, the pressure exerted at each nip can be readily determined.

According to a further preferred embodiment, the applicator roll, distribution roll, transfer roll and cylinder each extend vertically. The cylinder is mounted between a pair of opposite horizontally extending plate members and the mounting members are connected to the plate members by a pair of elongated arms each connected at one end to a respective mounting member and pivotally connected at the other end to a respective plate member. The cylinder is rotatable about a central longitudinal axis coincident with a rotation axis of a fourth central longitudinally extending shaft having opposite end portions each disposed within a stationary cylindrical sleeve member, the fourth shaft extending in spaced-apart parallel relation to the third shaft. A pair of support elements is arranged between the plate members with each support element being disposed in a respective one of the aforesaid parallel planes and fixedly connected to a respective sleeve member. The transfer roll positioning means comprises a strike means mounted on each mounting member and a catch means mounted on each support element for engagement with the strike means, whereby the catch means and the strike means cooperate with one another in an engagement position thereof to releasably hold the transfer roll in pressure contact engagement with the cylinder.

The apparatus of the invention advantageously includes third pressure adjustment means for adjustably varying the pressure at the third nip. Such third pressure adjustment means preferably comprises a separate pressure adjustment means associated with each cooperating catch means and strike means. Each separate pressure adjustment means comprises first and second abutment members mounted respectively on first and second support means, the first support means corresponding to one of the support element and mounting member with the second support means corresponding to the other of the support element and mounting member, the abutment members abutting against one another when the catch means and strike means are in the aforesaid engagement position, the first abutment member being fixedly mounted on the first support means and the second abutment member being pivotally mounted on the second support means for pivotal movement towards or away from the rotation axis of the fourth shaft. Each separate pressure adjustment means further includes means for adjustably moving the second abutment means towards or away from the rotation axis of the fourth shaft to correspondingly vary the distance between the third shaft and the fourth shaft and thereby vary the pressure exerted at the third nip when the catch means and strike means are in the engagement position, and means for retaining the second abutment member in a selected position relative to the rotation axis of the fourth shaft. The pressure exerted at the third nip generally ranges from 4.0 to about 5.5 kg/cm$^2$ and is preferably about 4.5 kg/cm$^2$.

Where the applicator roll, distribution roll, transfer roll and cylinder each extend vertically, the pair of mounting members thus defining respectively top and bottom wall members, the feed means advantageously comprises a receptacle mounted to the bottom wall member for containing a bath of the oily substance and conveyor means from conveying the oily substance from the bath to an upper portion of the applicator roll, the oily substance then flowing downwardly along the applicator roll and being carried to the first nip by the applicator roll during rotation thereof. Preferably, the conveyor means comprises a first pulley member mounted within the receptacle for rotation in the bath of oily substance, a second pulley member positioned adjacent the upper portion of the applicator roll, a belt interconnecting the first pulley member with the second pulley member, the second pulley member being disposed relative to the applicator roll such that the belt contacts the upper portion thereof, and drive means connected to the second pulley member for driving same and imparting motion to the belt. Thus, the belt upon passing around the first pulley member in the bath is coated with the oily substance and the oil coated belt upon passing around the second pulley member transfers the oily substance onto the applicator roll at the upper portion thereof.

On the other hand, where the metallic cylinder is used as the positive electrode in Applicant's aforementioned electrocoagulation printing apparatus and such a cylinder is formed of an electrolytically inert metal and has a passivated surface, the oily substance comprises an olefinic substance in admixture with a metal oxide. In order to apply the olefinic substance in the form of a dispersion containing the metal oxide as dispersed phase, the first pulley member advantageously includes agitator means for agitating the bath so as to disperse the metal oxide in the olefinic substance and thereby form the desired dispersion. A dispersing agent such as a non-ionic surfactant sold under the trade mark "Solsperse 3000" is preferably added to the dispersion to stabilize same. Examples of suitable olefinic substance which may be used include arachidonic acid, oleic acid, linoleic acid, linolenic acid, palmitoleic acid, corn oil, linseed oil, olive oil, peanut oil, soybean oil and sunflower oil. Examples of suitable metal oxides include aluminum oxide, ceric oxide, chromium oxide, cupric oxide, magnesium oxide, manganese oxide, titanium dioxide and zinc oxide. In a preferred embodiment of the invention, the agitator means comprises two pairs of elongated planar blade members extending laterally outwardly from each side of the first pulley member with the blade members of one pair extending in a first plane and the blade members of the other pair extending in a second plane, the first plane and second plane being orthogonal to one another and intersecting at the rotation axis of the first pulley member.

The apparatus of the invention advantageously includes sealing means associated with each of the applicator roll and distribution roll at a lower extremity thereof for preventing the oily substance from flowing through the shaft openings formed in the bottom wall member and receiving the first and second shafts. The applicator roll and distribution roll each define at the lower extremity thereof a downwardly facing annular abutment surface. Each sealing means comprises a cylindrical seal member receiving therethrough a respective one of the first and second shafts, the seal member having an upwardly facing annular sealing surface for sealing engagement with a respective abutment surface, and biasing means for urging the seal member against the respective abutment surface to effect the sealing engagement while permitting rotation of the applicator roll and distribution roll.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
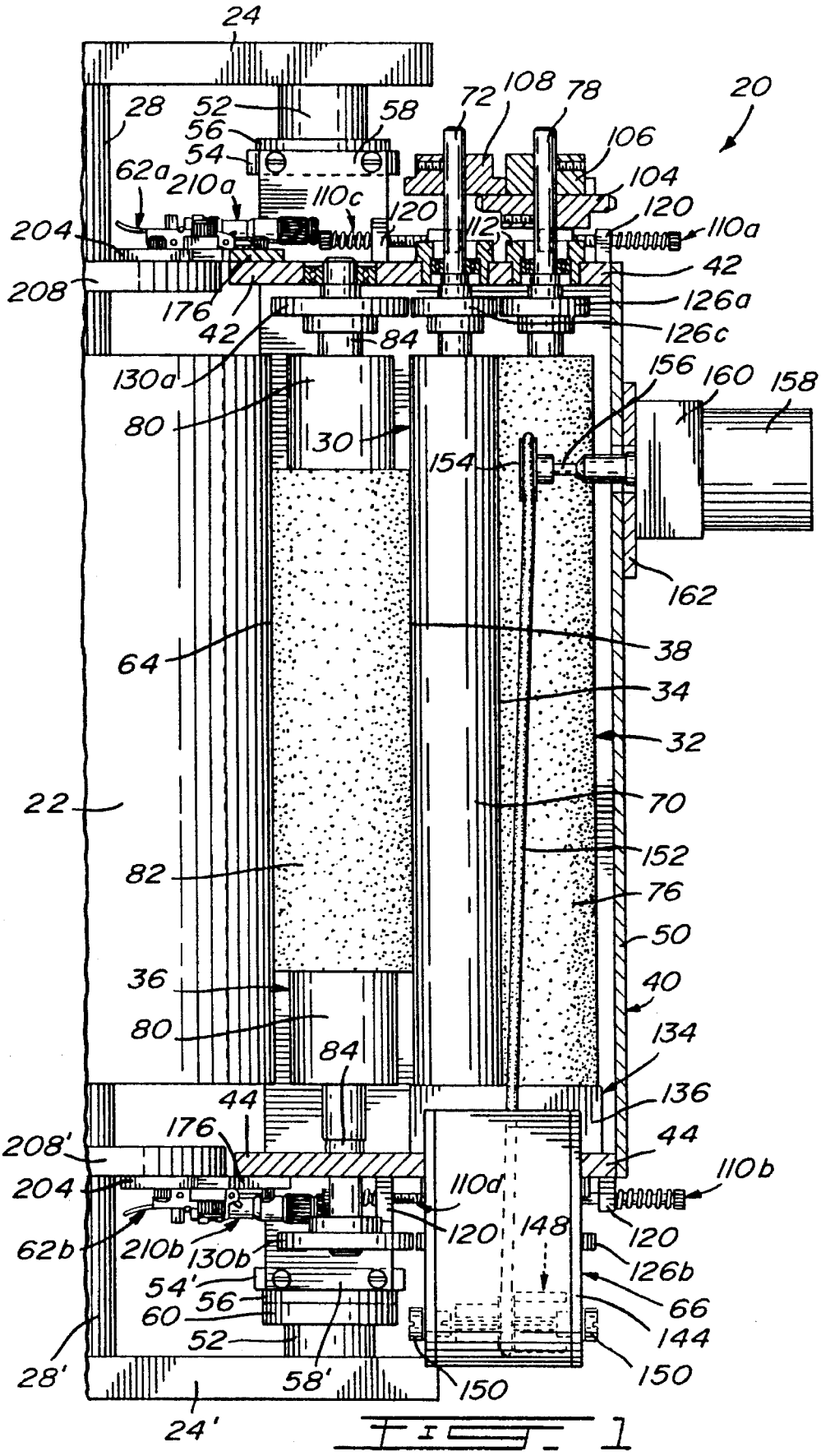
FIG. 1 is a part-sectional side elevation view of an apparatus according to a preferred embodiment of the invention, for coating a metallic cylinder.
Figure 2:
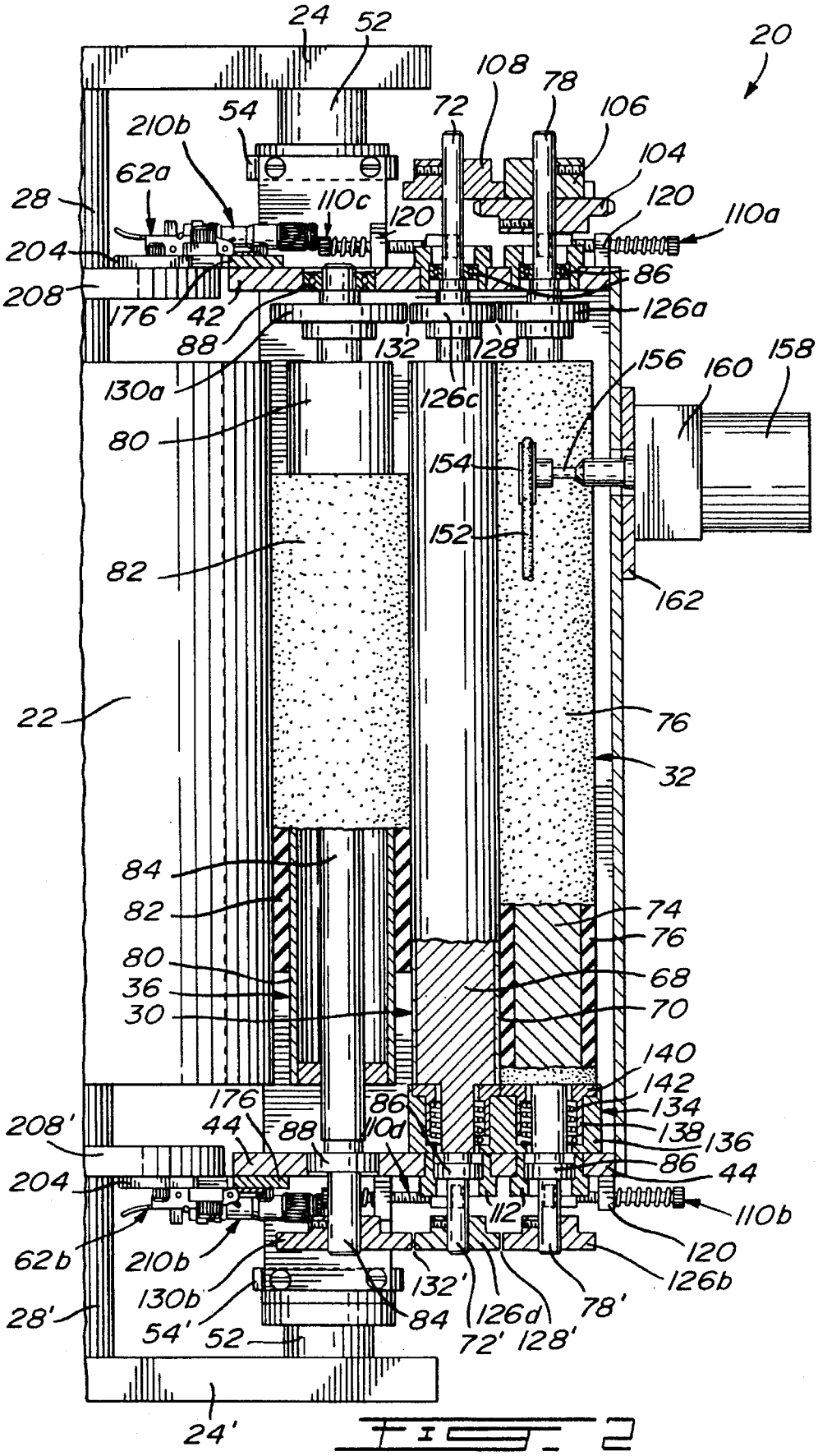
FIG. 2 is another part-sectional side elevation view of the apparatus shown in FIG. 1.
Figure 3:
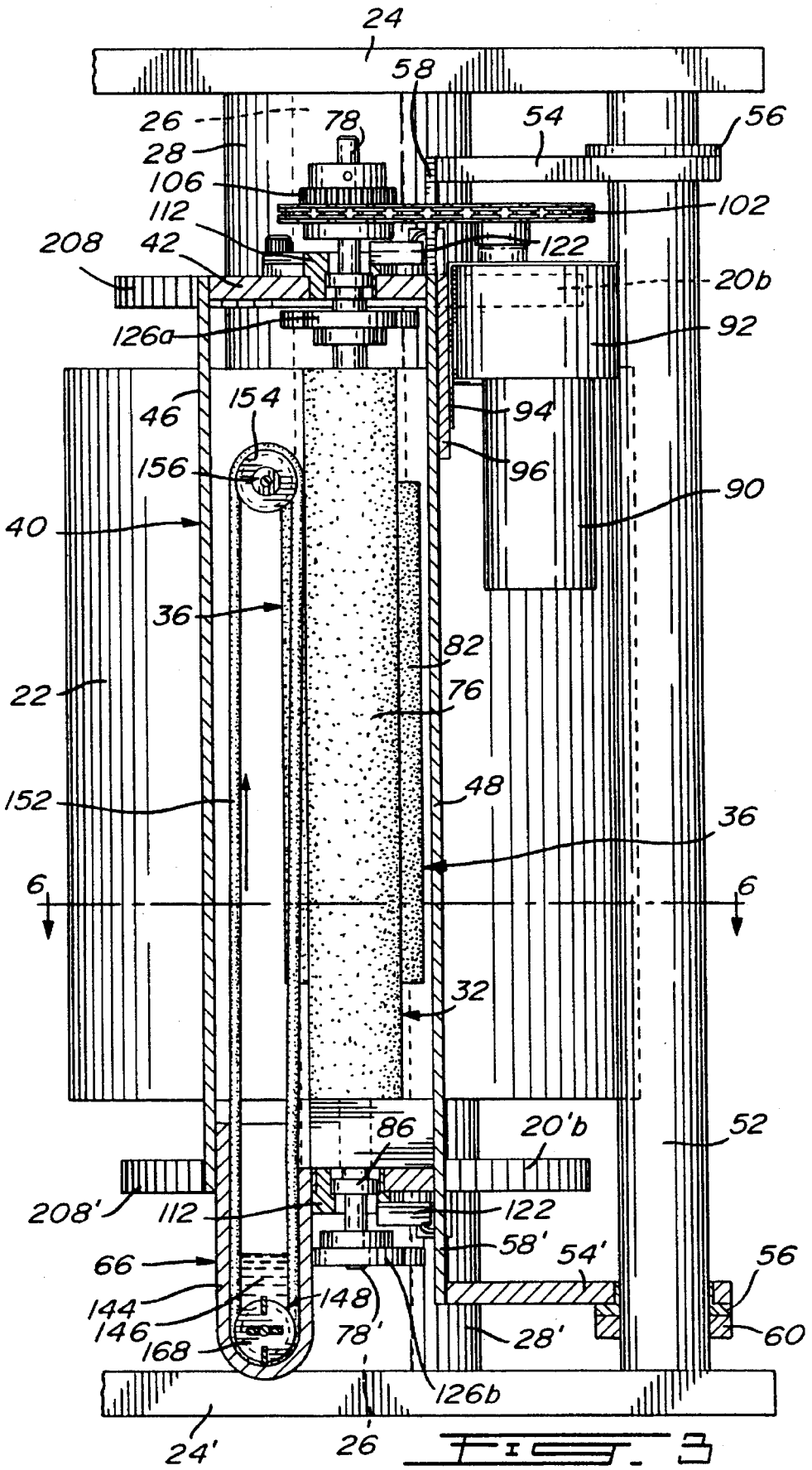
FIG. 3 is a part-sectional rear elevation view thereof.

Referring first to FIGS. 1–3, there is illustrated a coating apparatus which is generally designated by reference numeral 20 and which is especially adapted for coating the surface of a metallic cylinder 22 with an olefinic substance in admixture with a metal oxide, in a manner such as to form on the surface of the cylinder micro-droplets of olefinic substance containing the metal oxide and having substantially uniform size and distribution. The cylinder 22 extends vertically and is mounted between a pair of horizontal plates 24,24' for rotation about a central longitudinal axis coincident with the rotation axis of shaft 26 having opposite end portions disposed within cylindrical sleeves 28 and 28' fixed to the plates 24 and 24', respectively. The shaft 26 is adapted to be driven by a motor (not shown).

The coating apparatus 20 includes a vertically extending distribution roll 30, an applicator roll 32 extending parallel to the distribution roll 30 and in pressure contact engagement therewith to form a nip 34, and a transfer roll 36 extending parallel to the roll 30 and in contact engagement therewith to form a nip 38. The rolls 30, 32 and 36 are mounted in a housing 40 having a top wall 42, a bottom wall 44, a pair of sidewalls 46,48 and a rear wall 50. The housing 40 is pivotally mounted to a column 52 fixed at the ends thereof to plates 24,24' by a pair of arms 54,54' each having one end pivotally connected to the column 52 with a bushing 56. The arms 54 and 54' are respectively fixed at their other end to attachment plates 58 and 58' which are integral with the sidewall 48 of the housing 40. A support collar 60 is secured to the column 52 for supporting the lower arm 54' and thus the housing 40. Such an arrangement enables one to pivotally displace the housing 40 horizontally relative to the cylinder 22. The apparatus 20 further includes two strike and catch mechanisms **62*a*,62*b* for holding the transfer roll 36 in pressure contact engagement with the cylinder 22 to form a nip 64, as well as a feed system 66 for supplying to the applicator roll 32** the olefinic substance in the form of a dispersion containing the metal oxide as dispersed phase.

The distribution roll 30 has a solid core 68 of metal provided with a peripheral coating 70 of oxide ceramic material. A pair of stub shafts 72,72' integral with the core 68 extends outwardly from the extremities of the roll 30. The applicator roll 32 has also a solid core 74 of metal, but is provided with a peripheral covering 76 of polyurethane. A pair of stub shafts 78,78' integral with the core 74 extends outwardly from the extremities of the roll 32. The transfer roll 36, on the other hand, has a tubular core 80 provided with a peripheral covering 82 of polyurethane which extends part of the length of the core 80. The roll 36 is mounted on a central longitudinally extending shaft 84. The stub shafts 72,72' and 78,78' and the shaft 84 extend through shaft openings formed in the top and bottom walls 42,44, and are mounted in bearings 86 and 88 within the shaft openings.

Figure 4:
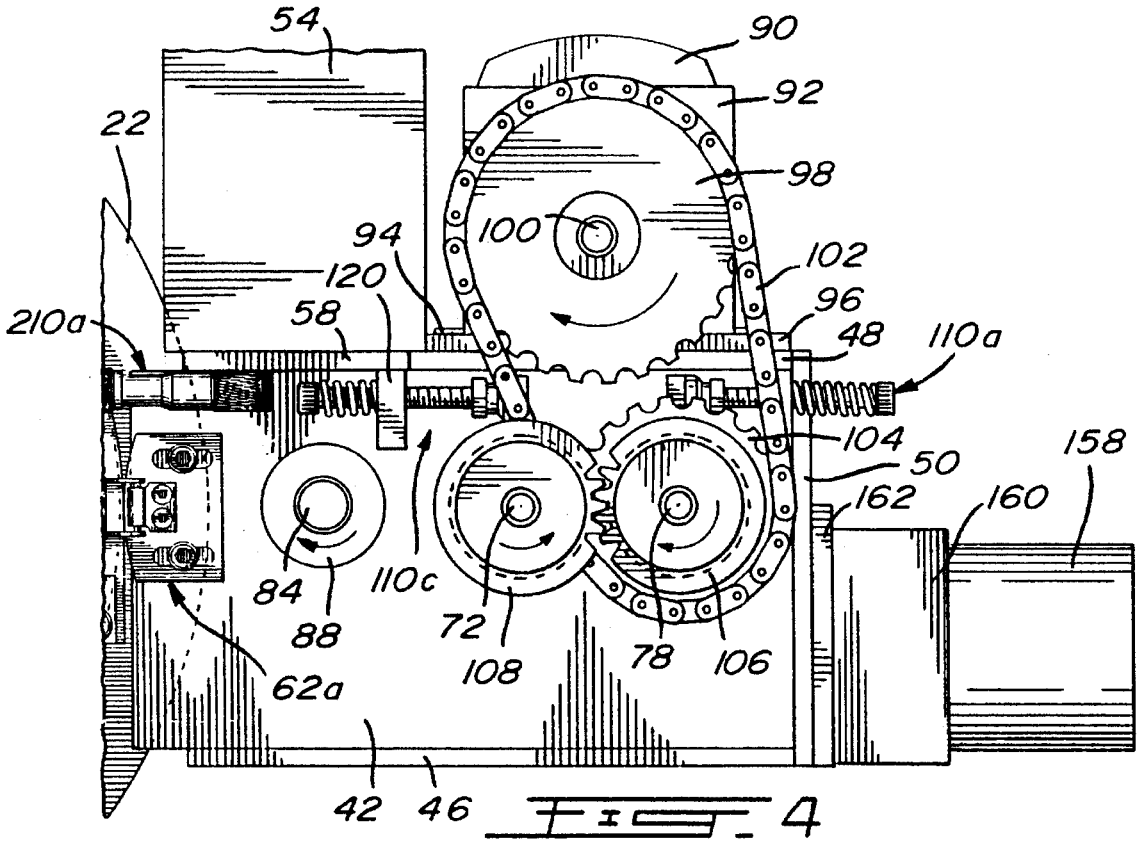
FIG. 4 is a top plan view thereof.

The distribution roll 30 and applicator roll 32 are rotated in register by means of a motor 90 and gearbox 92 which are mounted on the rear wall 48 by a bracket 94, a reinforcing plate 96 being interposed between the bracket 94 and wall 48. As shown in FIG. 4, a sprocket 98 keyed on the drive shaft 100 is connected by a driving chain 102 to a sprocket 104 keyed on the stub shaft 78 of roll 32. On the top of the stub shaft 78, there is a keyed gear 106 meshing with gear 108 fixed to the stub shaft 72 of roll 30. Thus, the drive from motor 90 which rotates the sprocket 98 in a clockwise manner transmits a clockwise rotation to the applicator roll 32 which in turn transmits a counterclockwise rotation to the distribution roll 30 through gears 106,108.

Figure 5:
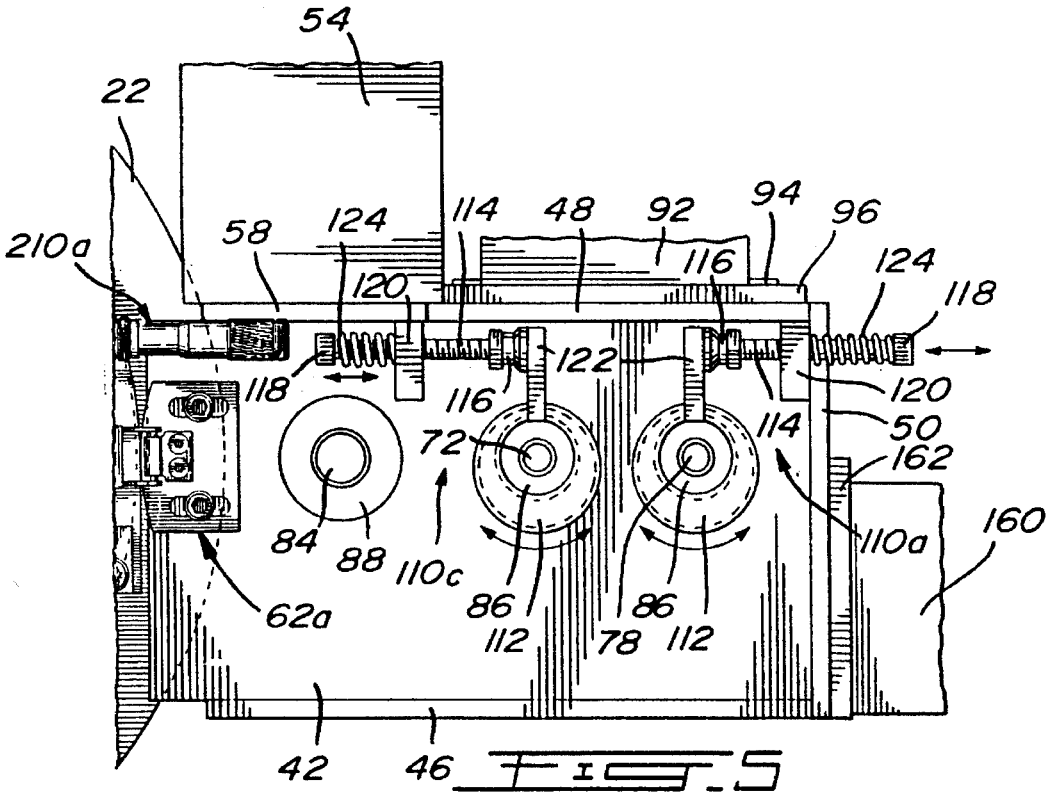
FIG. 5 is a fragmentary top plan view thereof.

The pressure exerted at the nip 34 is adjusted by means of two separate pressure adjustment units **110*a*,110*b*. As shown in FIG. 5, the unit 110*a* comprises a cylindrical member 112 rotatably mounted in the shaft opening receiving the stub shaft 78, with the bearings 86 being mounted within the member 112 such that the stub shaft 78 is offset relative to the central rotation axis of member 112. A threaded member 114 provided at one end with a swivelling head 116 and at the other end with a knob 118 is threadably engaged with a mounting element 120 fixed to the top wall 42. The head 116 is secured to an arm 122 which is fixedly connected to the member 112. A coil spring 124 extends around the threaded member 114 between the knob 118 and the mounting element 120 to prevent loosening of the member 114. The pressure adjustment unit 110*b* is identical to unit 110*a* and is mounted to the bottom wall 44. Thus, by rotating the knob 118, one can adjustably move the threaded member 114 so as to displace the arm 122 and partially rotate the cylindrical member 112, thereby adjustably moving the stub shafts 78,78' in a direction towards or away from the stub shafts 72,72' and correspondingly varying the pressure exerted at the nip 34. Two further pressure adjustment unit 110*c*,110*d* identical to the units 110*a*, 110*b* are provided for adjustably moving the stub shafts 72,72' in a direction towards or away from the shaft 84 to correspondingly vary the pressure exerted at the nip 38**.

In order to determine the pressure exerted at the nip 34, discs **126*a* and 126*b* are keyed on stub shafts 78 and 78', respectively; discs 126*c* and 126*d* are similarly keyed on stub shafts 72 and 72', respectively. As shown, the discs 126*a* and 126*c* are co-planar and spaced from one another to define a gap 128; the discs 126*b* and 126*d* are also co-planar and spaced from one another to define a gap 128'. The gaps 128 and 128' are representative of the distance between stub shafts 72 and 78 and of the distance between stub shafts 72' and 78', and are therefore representative of the pressure exerted at the nip 34. By measuring the gaps 128,128', one can thus readily determine the pressure at the nip 34**.

A similar arrangement is provided for determining the pressure exerted at the nip 38. As shown, discs **130*a* and 130*b* are keyed on the shaft 84 at the ends thereof. The discs 126*c* and 130*a* are co-planar and spaced from one another to define a gap 132; the discs 126*d* and 130*b* are also co-planar and spaced from one another to define a gap 132'. The gaps 132 and 132' are representative of the distance between the stub shaft 72 and shaft 84 and of the distance between the stub shaft 72' and shaft 84, and are therefore representative of the pressure exerted at the nip 38. Thus, by measuring the gaps 132,132', one can readily determine the pressure at the nip 38**.

Since the dispersion containing the olefinic substance and the metal oxide is applied onto the roll 32 at an upper portion thereof and is allowed to flow downwardly along the roll 32, a sealing unit 134 is arranged on the bottom wall 44 for supporting the lower extremities of rolls 30 and 32 while preventing the dispersion from flowing through the shaft openings formed in the wall 44 and receiving stub shafts 72',78'. The sealing unit 134 comprises a block 136 having two cylindrical bores formed therein and receiving the stub shafts 72' and 78'. A cylindrical seal member 138 having an annular flange 140 is mounted in each bore, each seal member 138 receiving therethrough a respective stub shaft. The annular flange 140 of each seal member 138 has an upwardly facing annular sealing surface for sealing engagement with the downwardly facing annular abutment surface defined at the lower extremity of each roll 30,32. A coil spring 142 is provided for urging each seal member 138 upwardly against a respective abutment surface to effect the desired sealing engagement while permitting rotation of the rolls 30 and 32.

The feed system 66 comprises a receptacle 144 mounted to the bottom wall 44 of the housing 40 for containing a bath 146 of olefinic substance in which the metal oxide is dispersed. A pulley/agitator member 148 is mounted within the receptacle 144 for rotation in the bath 146 by means of threaded plugs 150 threadably engaged with the walls of the receptacle. A belt 152 interconnects the pulley/agitator member 148 with a pulley 154 keyed on a shaft 156 which is driven by a motor 158. The belt 152 is formed of an oil-resistant polymeric material such as a butadiene acrylonitrile elastomers. The pulley 154 is disposed relative to the applicator roll 32 such that the belt 152 contacts an upper portion thereof. A gearbox 160 is provided for varying the speed of rotation of the shaft 156. The gearbox 160 is secured to a reinforcing plate 162 mounted to the rear wall 50.

Figure 6:
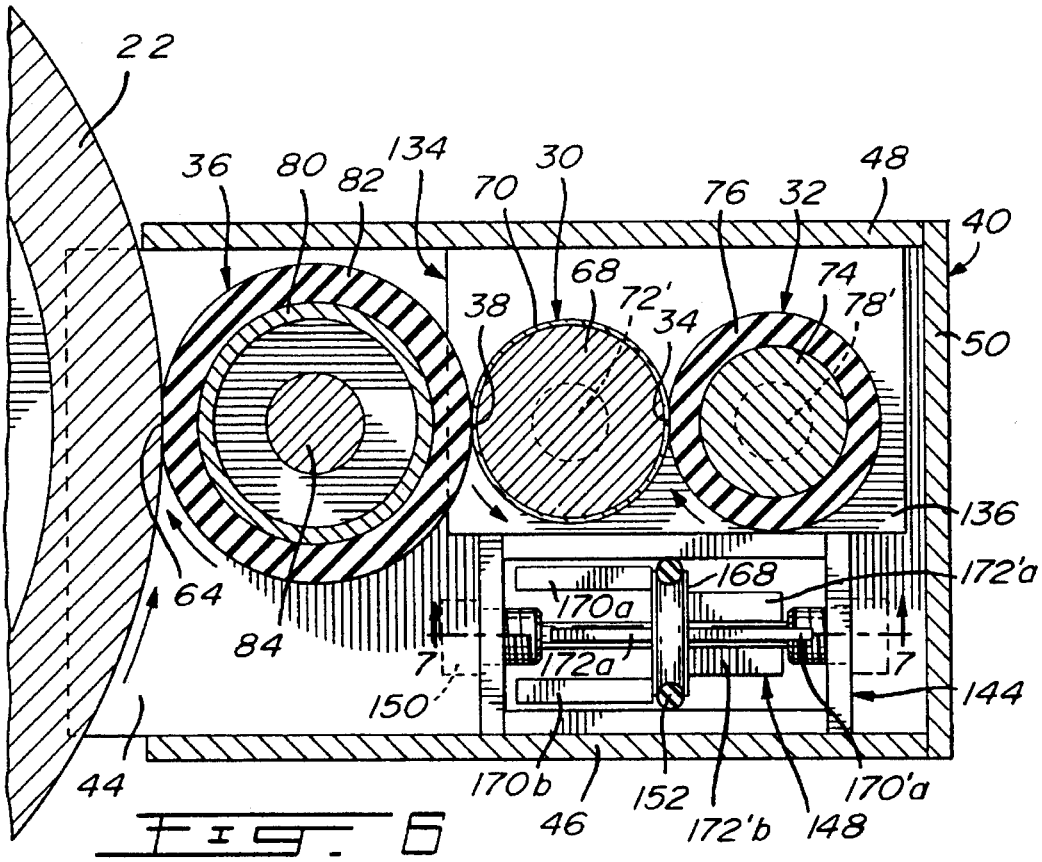
FIG. 6 is a sectional view taken along line 6—6 of FIG. 3.
Figure 7:
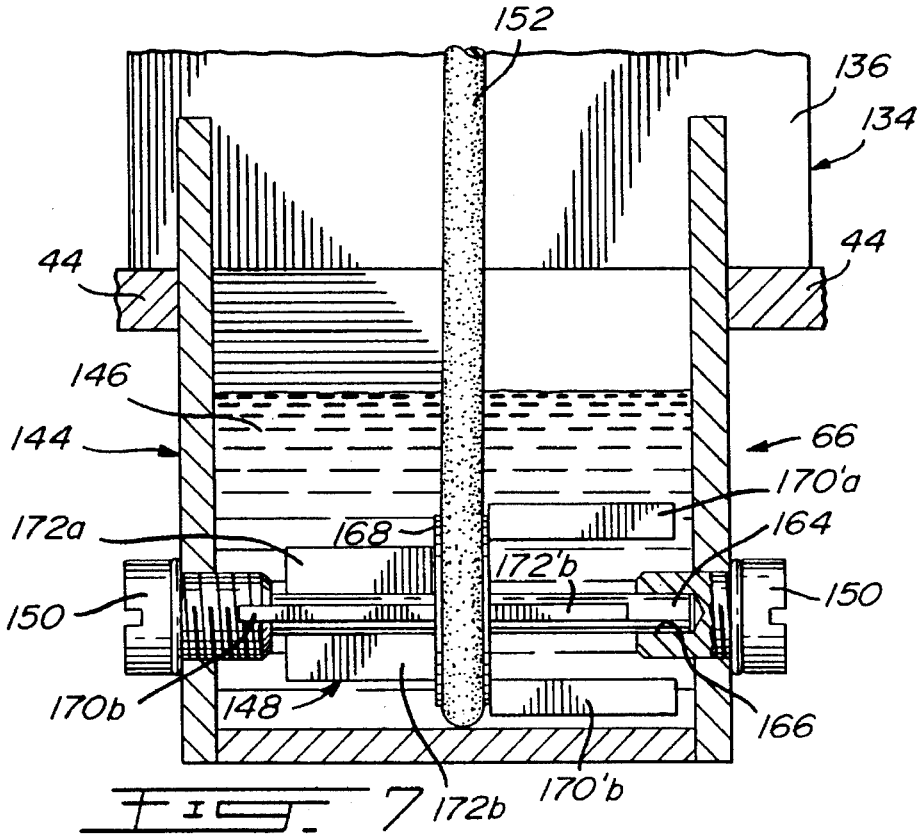
FIG. 7 is a sectional view taken along line 7—7 of FIG. 6.
Figure 8:
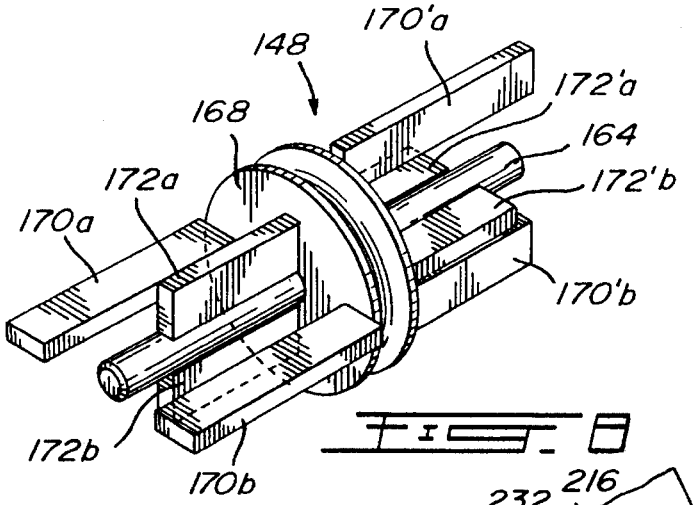
FIG. 8 is a perspective view of the agitator means used for forming a dispersion of olefinic substance containing a metal oxide as dispersed phase.

As shown in FIGS. 6–8, the pulley/agitator member 148 comprises a central longitudinally extending shaft 164 each end of which is received in a blind-bore 166 formed in each plug 150. A pulley 168 is secured to the shaft 164. Two pairs of elongated planar blade members 170*a*,170*b* and 172*a*, 172*b* extend laterally outwardly from one side of the pulley 168; the blade members 172*a*,172*b* terminate short of the blade members 170*a*,170*b*. Two pairs of elongated blade members 170'*a*, 170'*b* and 172'*a*,172'*b* also extend laterally outwardly from the other side of pulley 168, the blade members 172'*a*, 172'*b* terminating short of the blade members 170'*a*,170'*b*. The blade members 170*a*, 170*b* extend in a plane which is orthogonal to the plane in which the shorter blade members 172*a*,172*b* extend. Similarly, the blade members 170'*a*, 170'*b* extend in a plane which is orthogonal to the plane in which the shorter members 172'*a*, 172'*b* extend. However, the blade members 170*a*,170*b* on one side of the pulley 168 extend in the same plane as the blade members 172'*a*,172'*b* on the other side of the pulley; similarly, the blade members 172*a*,172*b* extend in the same plane as the blade members 170'*a*,170'*b*. Such an arrangement is particularly effective for agitating the bath 146 to form the desired dispersion.

When the shaft 156 is driven by motor 158 to rotate the pulley 154, motion is transmitted by the belt 152 to the pulley/agitator member 148 to rotate same and thereby agitate the bath 146. As the belt 152 passes around the pulley 168 in the bath 146, it becomes coated with the dispersion and the dispersion-coated belt upon passing around the pulley 154 transfers the dispersion onto the applicator roll 32 at the upper portion thereof. The dispersion then flows downwardly under gravity along the roll 32 and is carried to the nip 34 by the roll 32 during rotation thereof. The dispersion upon passing through the nip forms a film uniformly covering, the surface of the ceramic coating 70 of distribution roll 30, the film of olefinic substance containing the metal oxide breaking down into micro-droplets having substantially uniform size and distribution. The micro-droplets formed on the roll 30 are carried by the latter to the nip 38 where they are transferred onto the transfer roll 36.

Figure 9:
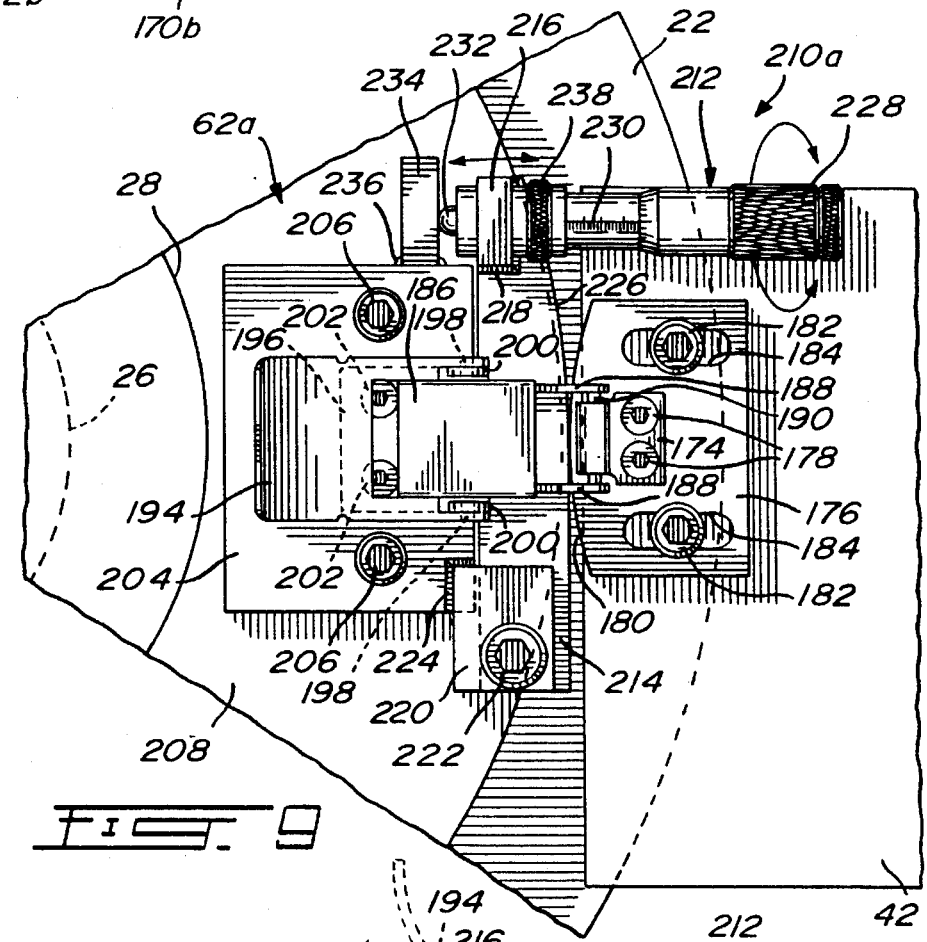
FIG. 9 is a fragmentary top plan view showing the strike and catch means used for holding the transfer roll in pressure contact engagement with the cylinder.
Figure 10:
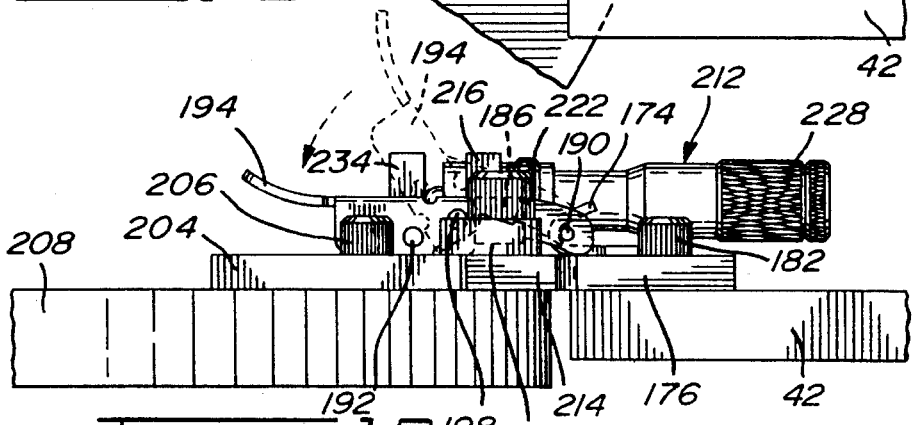
FIG. 10 is a fragmentary side elevation view of the embodiment shown in FIG. 9.

Two separate strike and catch mechanisms 62*a*,62*b* are used for releasably holding the transfer roll 36 in pressure contact engagement with the cylinder 22 to permit the roll 36 to be driven by the cylinder 22 upon rotation thereof and also to enable the micro-droplets to be transferred from the roll 36 onto the cylinder 22 at the nip 64. The strike and catch mechanism 62*a* which is identical to the mechanism 62*b* is illustrated in FIGS. 9 and 10. As shown, the mechanism 62*a* comprises a hook-shaped strike member 174 which is secured to an abutment plate 176 by fasteners 178; the abutment plate 176 has an arcuate abutment edge 180 and is adjustably mounted on the top wall 42 of housing 40 by fasteners 182 extending through slots 184 formed in the plate 176. The mechanism 62*a* further includes a catch member 186 having a pair of opposite parallel fingers 188 with a pin 190 extending therebetween. The catch member 186 is pivotally connected by a pivot pin 192 to a lever arm 194 which in turn is pivotally connected to a base plate 196 by pivot pins 198 extending through a pair of spaced-apart opposite lugs 200 integral with the plate 196. The base plate 196 is secured by fasteners 202 to a mounting plate 204 fixed by fasteners 206 to a support disc 208 which is fixedly connected to the sleeve 28 and extends in the same plane as the top wall 42.

The strike and catch mechanism 62*b* is arranged in a similar manner with the abutment plate 176 thereof being adjustably mounted to the bottom wall 44 and the mounting plate 204 being fixed to a support disc 208' which is fixedly connected to the sleeve 28' and extends in the same plane as the bottom wall 44. The strike and catch mechanisms 62*a*,62*b* are operated by engaging the pin 190 of catch member 186 with the hook-shaped strike member 174, as shown in FIG. 10. The lever arm 194 is then pivoted about the pivot pins 198 from the position illustrated in broken lines to the position illustrated in solid lines, thereby exerting a pulling action on the catch member 186 to pull the transfer roll 36 against the cylinder 22 and thus releasably hold the roll 36 in pressure contact engagement with the cylinder 22.

Two separate pressure adjustment systems 210*a*,210*b* associated respectively with the strike and catch mechanisms 62*a*,62*b* are provided for adjusting the pressure at the nip 64. The pressure adjustment system 210*a* which is identical to the system 210*b* is illustrated in FIGS. 9 and 10. As shown, the system 210*a* includes a micrometer head 212 which is fixedly mounted on an elongated abutment plate 214 by means of an attachment member 216 fixed to one end of the plate 214 by soldering 218. The abutment plate 214 is pivotally connected at the other end thereof to an attachment member 220 by means of a fastener 222 which is rotatably mounted in a through-bore formed in the member 220, thereby enabling the plate 214 to pivotally move in a direction towards of away from the shaft 26 of the cylinder 22. The attachment member 220 is fixed to the mounting member 202 by soldering 224. The abutment plate 214 has an arcuate edge portion 226 adapted to abut against the arcuate edge 180 of abutment plate 176. The micrometer head 212, on the other hand, comprises a thimble 228 which is rotatably mounted on a sleeve 230 for axially moving a spindle 232 outwardly or inwardly of the sleeve 230. The spindle 230 is adapted to abut against an abutment member 234 fixed to the mounting plate 204 by soldering 236. Thus, by rotating the thimble 228 to adjustably move the spindle in abutting contact engagement with the member 216, one can adjustably pivot the abutment plate 214 in abutting contact engagement with the abutment plate 176 in a direction towards of away from the shaft 26 to correspondingly vary the distance between the shaft 84 of transfer roll 36 and the shaft 26 of cylinder 22 and thereby vary the pressure exerted at the nip 64. The micrometer 212 is provided with a spindle lock 238 to lock the spindle at a predetermined length and thereby retain the abutment plate 214 in a selected position relative to the shaft 26.

It should be noted that the number of microdroplets transferred onto the transfer roll 36 and ultimately on the cylinder 22 can be carried by varying the speed of rotation of the distribution roll 30 and applicator roll 32. The thickness of the micro-droplets, on the other hand, can be varied by varying the pressure exerted at the nip 34.

We claim:

1. A method of coating a metallic substrate with an oily substance, which comprises the steps of:

a) providing a support member having a ceramic coating comprising an oxide ceramic material;

b) applying the oily substance onto the ceramic coating to form on a surface thereof a film of said oily substance uniformly covering the surface of said ceramic coating, said film of oily substance breaking down into micro-droplets having substantially uniform size and distribution; and c) transferring the micro-droplets of oily substance onto a surface of said metallic substrate without substantially altering the size and distribution of said micro-droplets, thereby coating the surface of said metallic substrate with said oily substance.

2. A method as claimed in claim 1, wherein said oxide ceramic material comprises a fused mixture of alumina and titania.

3. A method as claimed in claim 2, wherein said mixture comprises about 60 to about 90 weight % of alumina and about 10 to about 40 weight % of titania.

4. A method as claimed in claim 2, wherein said ceramic coating is a flame-sprayed coating of alumina and titania.

5. A method as claimed in claim 1, wherein said support member is a distribution roll having a peripheral coating of said oxide ceramic material defining said ceramic coating, and wherein step (b) is performed by disposing an applicator roll parallel to said distribution roll and in pressure contact engagement therewith to form a first nip, and rotating said applicator roll and said distribution roll in register while feeding said oily substance into said first nip, whereby said oily substance upon passing through said first nip forms said film uniformly covering the surface of said ceramic coating.

6. A method as claimed in claim 5, wherein said applicator roll is provided with a peripheral covering of a resilient, oil-resistant material.

7. A method as claimed in claim 6, wherein said resilient, oil-resistant material is a synthetic rubber material.

8. A method as claimed in claim 7, wherein said synthetic rubber material comprises a polyurethane.

9. A method as claimed in claim 5, wherein a pressure of about 0.2 to about 1.5 kg/cm$^2$ is exerted at said first nip.

10. A method as claimed in claim 5, wherein said substrate is a rotatable metallic cylinder and step (c) is performed by disposing a transfer roll parallel to said distribution roll and in contact engagement therewith to form a second nip, said transfer roll extending parallel to said cylinder, positioning said transfer roll in pressure contact engagement with said cylinder to form a third nip, and rotating said transfer roll and said cylinder in register for transferring said micro-droplets from said distribution roll onto said transfer roll at said second nip and thereafter transferring said micro-droplets from said transfer roll onto said cylinder at said third nip.

11. A method as claimed in claim 10, wherein said transfer roll is provided with a peripheral covering of a resilient, oil-resistant material.

12. A method as claimed in claim 11, wherein said resilient, oil-resistant material is a synthetic rubber material.

13. A method as claimed in claim 12, wherein said synthetic rubber material comprises a polyurethane.

14. A method as claimed in claim 10, wherein a pressure of about 0.2 to about 0.6 kg/cm$^2$ is exerted at said second nip.

15. A method as claimed in claim 10, wherein a pressure of about 4.0 to about 5.5 kg/cm$^2$ is exerted at said third nip.

16. A method as claimed in claim 10, wherein said cylinder, said transfer roll, said distribution roll and said applicator roll each extend vertically, and wherein said oily substance is fed into said nip by conveying said oily substance from a bath containing same to an upper portion of said applicator roll and allowing said oily substance to flow downwardly under gravity along said applicator roll, whereby said oily substance is carried to said first nip by said applicator roll during rotation thereof.

17. A method as claimed in claim 10, wherein said cylinder is formed of an electrolytically inert metal and the surface of said cylinder onto which said-micro-droplets of oily substance are transferred is a passivated surface, and wherein said oily substance comprises an olefinic substance in admixture with a metal oxide.

18. A method as claimed in claim 17, wherein said olefinic substance is selected from the group consisting of arachidonic acid, oleic acid, linoleic acid, linolenic acid, palmitoleic acid, corn oil, linseed oil, olive oil, peanut oil, soybean oil and sunflower oil, and wherein said metal oxide is selected from the group consisting of aluminum oxide, ceric oxide, chromium oxide, cupric oxide, magnesium oxide, manganese oxide, titanium dioxide and zinc oxide.

19. A method as claimed in claim 17, wherein said olefinic substance is applied in the form of a dispersion containing said metal oxide as dispersed phase, a dispersing agent being present in said dispersion to stabilize same.

* * * * *